US007971947B2

(12) United States Patent
Burchette

(10) Patent No.: US 7,971,947 B2
(45) Date of Patent: Jul. 5, 2011

(54) SYSTEMS AND METHODS FOR REMANUFACTURING IMAGING COMPONENTS

(75) Inventor: Lynton R. Burchette, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 751 days.

(21) Appl. No.: 12/080,903

(22) Filed: Apr. 7, 2008

(65) Prior Publication Data

US 2009/0251513 A1 Oct. 8, 2009

(51) Int. Cl.
*B41J 2/195* (2006.01)

(52) U.S. Cl. ..... 347/7; 347/5; 347/84; 347/85; 347/86; 347/87

(58) Field of Classification Search ..... 347/5, 7, 347/84–87
See application file for complete search history.

(56) References Cited

U.S. PATENT DOCUMENTS 6,213,579 B1 * 4/2001 Cornell et al. ..... 347/14
6,224,198 B1 * 5/2001 Cook et al. ..... 347/85
6,250,751 B1 * 6/2001 Whitney et al. ..... 347/87
6,412,894 B1 * 7/2002 Askren et al. ..... 347/7
6,902,256 B2 * 6/2005 Anderson et al. ..... 347/56
2005/0030344 A1 * 2/2005 Edelen et al. ..... 347/59
2009/0153602 A1 * 6/2009 Brown et al. ..... 347/7

* cited by examiner

*Primary Examiner* — Ryan Lepisto
*Assistant Examiner* — Guy G Anderson

(57) ABSTRACT

An ink jet remanufacturing chip verifier for new ink jet chips attached to remanufactured ink jet cartridges includes a controller for verifying during the process of remanufacturing the ink jet cartridges: if the new ink jet chips attached to the remanufactured ink jet cartridges are new ink jet chips, if the new ink jet chips attached to the remanufactured ink jet cartridges were manufactured by a predetermined manufacturer of new ink jet chips, if the new ink jet chips attached to the remanufactured ink jet cartridges are functional, and if the new ink jet chips attached to the remanufacture ink jet cartridges are a predetermined type of new ink jet chip; the controller for rejecting during the process of remanufacturing the ink jet cartridges: ink jet chips attached to remanufactured ink jet cartridges which have been previously used, ink jet chips attached to remanufactured ink jet cartridges which produced by manufacturers other than the predetermined manufacturer of inkjet chips, inkjet chips attached to remanufactured inkjet cartridges which are not functional, inkjet chips attached to remanufactured inkjet cartridges which are not a predetermined type of new inkjet chips; and a user interface for communicating the verification or rejection of the new ink jet chips from the controller during the process of remanufacturing.

5 Claims, 2 Drawing Sheets

SYSTEMS AND METHODS FOR REMANUFACTURING IMAGING COMPONENTS

BACKGROUND

The present invention generally relates to remanufacturing and repairing replaceable imaging components, and more particularly to techniques for remanufacturing a replaceable imaging cartridge such as an inkjet cartridge including a memory element.

In the imaging industry, there is a growing market for the remanufacture and refurbishing of various types of replaceable imaging components such as toner cartridges, ink cartridges, and the like. Imaging cartridges, once spent, are unusable for their originally intended purpose. Without a refurbishing process, these cartridges would simply be discarded, even though the cartridge itself may still have potential life. As a result, techniques have been developed to remanufacture imaging cartridges. These processes may entail, for example, the disassembly of the various structures of the cartridge, replacing toner or ink, cleaning, adjusting or replacing any worn components and reassembling the cartridge.

Some imaging cartridges may include a chip having a memory device which is used to store data related to the cartridge or an imaging device, such as a printer, for example. The printer reads this data to determine certain printing parameters and communicate information to the user. For example, the memory may store the model number of the cartridge so that the printer may recognize the cartridge as one which is compatible with that particular printer. Additionally, by way of example, the cartridge memory may store the number of pages that can be expected to be printed from the cartridge during a life cycle of the cartridge and other useful data. The printer may also write certain data to the memory device, such as the amount of ink or toner remaining in the cartridge. Other data stored in the cartridge may relate to the usage history of the imaging cartridge.

SUMMARY

In accordance with one aspect of the present invention, an ink jet remanufacturing chip verifier for new ink jet chips attached to remanufactured ink jet cartridges includes processing circuitry for verifying during the process of remanufacturing the ink jet cartridges: if the new ink jet chips attached to the remanufactured ink jet cartridges are new ink jet chips, if the new ink jet chips attached to the remanufactured ink jet cartridges were manufactured by a predetermined manufacturer of new ink jet chips, if the new ink jet chips attached to the remanufactured ink jet cartridges are functional, and if the new ink jet chips attached to the remanufacture ink jet cartridges are a predetermined type of new ink jet chip; the processing circuitry for rejecting during the process of remanufacturing the ink jet cartridges: ink jet chips attached to remanufactured ink jet cartridges which have been previously used, ink jet chips attached to remanufactured ink jet cartridges which produced by manufacturers other than the predetermined manufacturer of ink jet chips, ink jet chips attached to remanufactured inkjet cartridges which are not functional, inkjet chips attached to remanufactured inkjet cartridges which are not a predetermined type of new inkjet chips; and a user interface for communicating the verification or rejection of the new ink jet chips from the controller during the process of remanufacturing.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing or remanufacturing an inkjet cartridge including a memory element are disclosed. Other embodiments having different structures and operations for the repair of other types of replaceable imaging components and for various types of imaging devices do not depart from the scope of the present invention.

Figure 1:
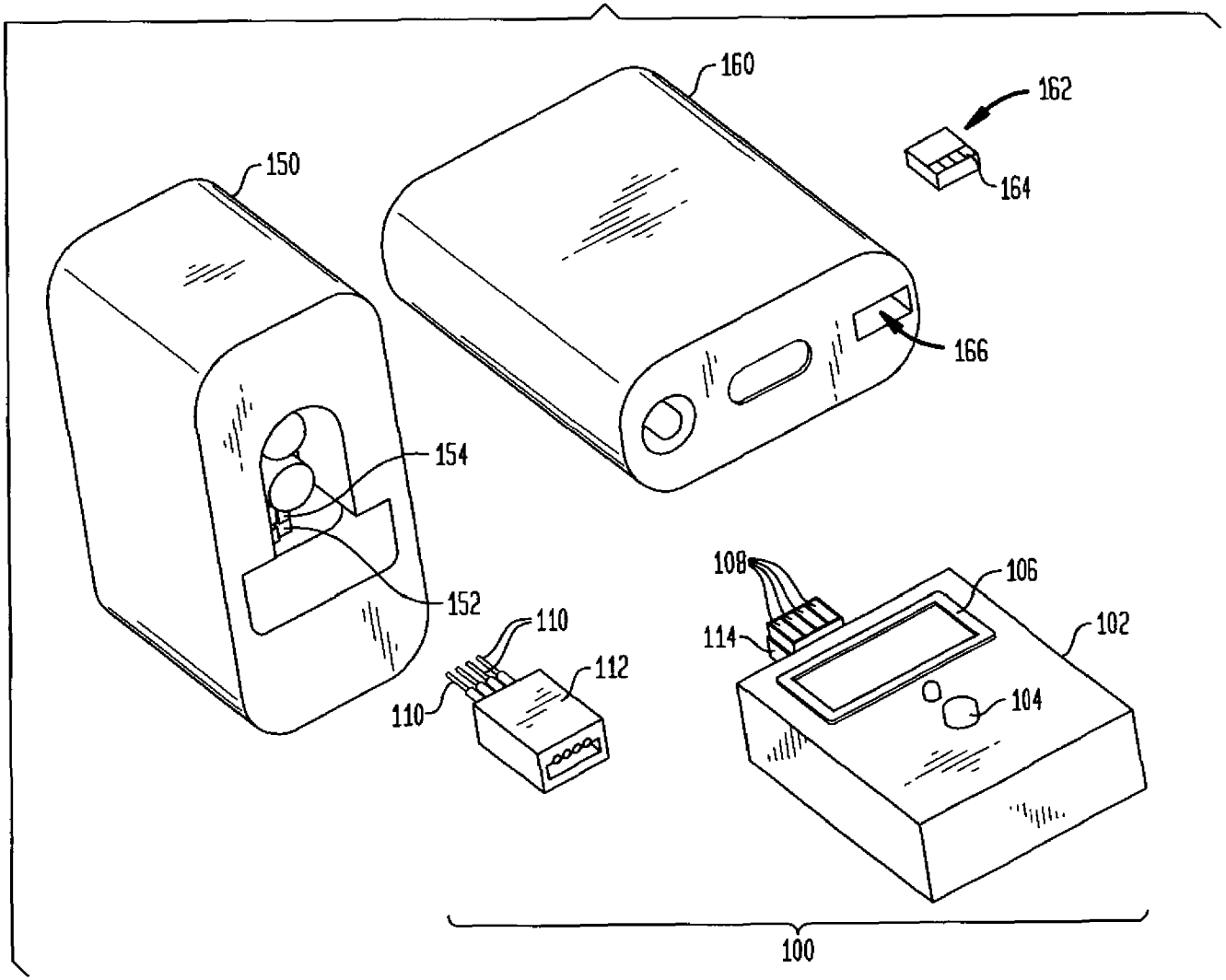
FIG. 1 shows a perspective view of an inkjet remanufacturing chip verifier and exemplary inkjet chips in accordance with the present invention.

FIG. 1 illustrates a perspective view of an inkjet remanufacturing chip verifier 100 in accordance with the present invention. Also shown in FIG. 1 are exemplary remanufactured inkjet cartridges 150 and 160. The inkjet cartridge 150 includes an inkjet chip 152 held in a recess. The inkjet chip 152 includes contacts 154 for communicating with a printer. The inkjet cartridge 160 includes an inkjet chip 162 having contacts 164. The inkjet chip 162 is held in a slot 166 when attached to the inkjet cartridge 160. These new inkjet chips are placed on the used inkjet cartridges 150 and 160 by a remanufacturer when the inkjet cartridges are refilled with ink and refurbished. The new inkjet chips typically include memory and other circuitry to control communication. The data stored in memory of the inkjet chips may include cartridge ink color, cartridge type, date manufactured, cartridge install date, cartridge expiration date, manufacturer name, and ink usage data, for example.

The inkjet remanufacturing chip verifier 100 includes a housing 102 enclosing circuitry described in greater detail below. A user interface may include a one or more input devices 104 that are utilized by a user to control the operation of the inkjet remanufacturing chip verifier 100, or enter data, commands and the like. The input devices 104 may include switches, buttons, a keypad, a microphone, a data input port and the like. The user interface may also include one or more output devices 106 that are utilized to communicate with the user. The output devices 106 may include a display, light emitting diodes (LED), a speaker, data output port and the like. For inkjet chips which communicate directly using one or more contacts or pads (such as inkjet chips 150 and 160), the inkjet remanufacturing chip verifier 100 includes one or more contacts 108 which are used to communicatively connect to the contacts of the inkjet chip in order to transmit data to and receive data from the inkjet chip. Contacts 108 are disposed along a probe tip 114 of the inkjet remanufacturing chip verifier 100 and are adapted for engaging the contacts 164 of the inkjet chip 162 when the inkjet chip is disposed in the slot 166. An extension element 112 including extension pins 110 may be attached to the probe tip 114 to allow the inkjet remanufacturing chip verifier 100 to access the contacts of inkjet chips which are held in a recess, such as contacts 154 of inkjet chip 152.

For inkjet chips which communicate utilizing radio frequency (RF), an RF antenna, rather than contacts 108, may be used in conjunction with appropriate circuitry to allow the inkjet remanufacturing chip verifier 100 to communicate with such devices.

Figure 2:
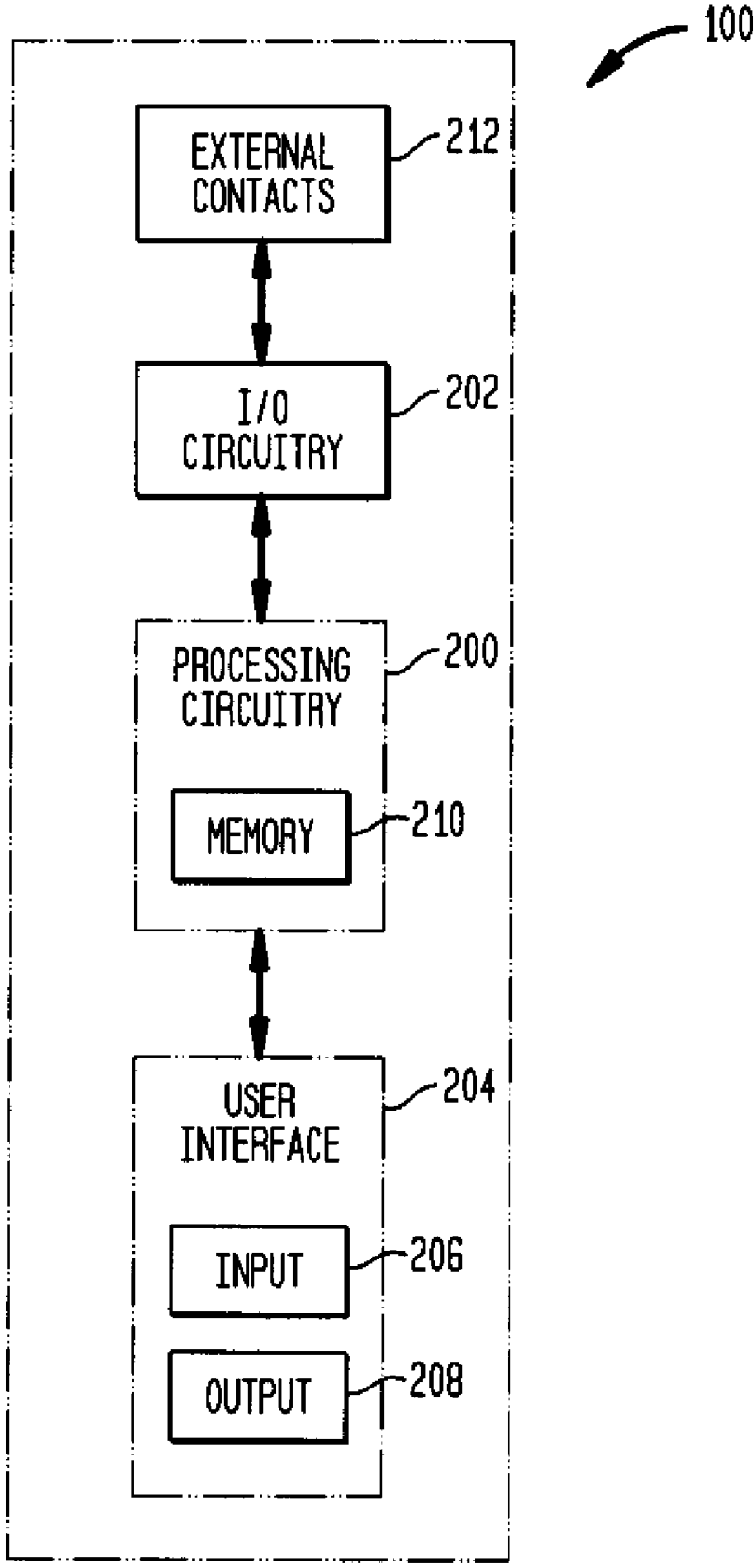
FIG. 2 shows a functional block diagram of an inkjet remanufacturing chip verifier in accordance with the present invention.

FIG. 2 shows a functional block diagram of the inkjet remanufacturing chip verifier 100 in accordance with the present invention. The inkjet remanufacturing chip verifier 100 includes processing circuitry 200 or controller communicatively connected to chip input/output (I/O) circuitry 202 and a user interface 204. The user interface 204 preferably comprises an output device 208, such as a display or LED, for example, and an input device 206, such as a keypad, for example. The processing circuitry 200 includes memory 210 which may suitably comprise both volatile memory and non-volatile memory for storing data and programming code controlling the operation of the inkjet remanufacturing chip verifier 100. The input/output (I/O) circuitry 202 is communicatively connected to external contacts 212 and provides the appropriate components and electronic interface to allow the processing circuitry 200 to communicate with the cartridge memory element through the contacts 212. Electrical power for the operation of the inkjet remanufacturing chip verifier 100 may be suitably provided by one or more batteries, a connection to an external DC source and/or a connection to an AC power source.

The processing circuitry 200 controls the operation of the inkjet remanufacturing chip verifier 100 and performs a variety of operations, as described in greater detail below. The processing circuitry 200 may be suitably implemented as a custom or semi-custom integrated circuit, a programmable gate array, a microprocessor executing instructions from memory, a microcontroller, or the like, for example. The processing circuitry 200 controls the reading of data from the inkjet chip and analysis of that data. The processing circuitry 200 controls the user interface 204, receiving commands and data from the input devices 206 and outputting data, such as analysis results, on the output device 208.

The inkjet remanufacturing chip verifier 100 may be used as a part of a remanufacturing production line in which used inkjet cartridges are refurbished, filled with ink and provided with a new inkjet chip. At the end of the remanufacturing line (after the new inkjet chip has been attached to the remanufactured inkjet cartridge), the inkjet remanufacturing chip verifier 100 may be used to verify certain characteristics of the new inkjet chips, thereby insuring, among other things, that the correct inkjet chip was attached to the remanufactured inkjet cartridge. A user of the inkjet remanufacturing chip verifier 100 may use the input device 206 of the user interface 204 to select a particular type of chip to verify.

By reading data from the memory of the inkjet chip and comparing that read inkjet chip data to reference inkjet chip data stored in the memory 210, the processing circuitry 200 of the inkjet remanufacturing chip verifier 100 may verify, for example, if the inkjet chip is new chip and has not been used, if the inkjet chip was manufactured by a particular manufacturer of inkjet chips, if the inkjet chip is functional and if the inkjet chip is a particular type of inkjet chip. The reference inkjet chip data stored in the memory 210 may include inkjet chip data for a plurality of inkjet chip types, allowing the user to instruct the inkjet remanufacturing chip verifier 100 to determine whether or not a particular chip is present, or determine, based the plurality of reference inkjet chip data, what type of chip is present. The reference inkjet chip data may suitably comprise a copy of the data expected to be stored in the memory of the inkjet chips.

The processing circuitry of the inkjet remanufacturing chip verifier 100 may further reject during the process of remanufacturing the ink jet cartridges: ink jet chips attached to remanufactured ink jet cartridges which have been previously used, ink jet chips attached to remanufactured ink jet cartridges which produced by manufacturers other than a particular manufacturer of ink jet chips, ink jet chips attached to remanufactured inkjet cartridges which are not functional, and inkjet chips attached to remanufactured inkjet cartridges which are not a particular type of new inkjet chips.

After the processing circuitry 200 completes the verification and rejection techniques described above, the processing circuitry 200 communicates with the user interface 204 to indicate the verification or rejection of the new ink jet to the user during the process of remanufacturing. For example, if the inkjet chip does not meet certain criteria, the user interface may indicate that status with a light or sound. Alternatively, the details of the type of inkjet chip may be displayed on a display of the user interface 204.

Such testing of the inkjet chip allows the remanufacturer to verify the operation of the inkjet chip without subjecting the remanufactured inkjet cartridge to some type of print testing. Print testing is generally not practical with inkjet chips as the inkjet chip would interpret the test as the first installation, causing the inkjet to store an incorrect installation date in chip memory and possibly limiting the warranty period.

Although specific embodiments have been illustrated and described herein, those of ordinary skill in the art will appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An inkjet remanufacturing chip verifier for new inkjet chips attached to remanufactured inkjet cartridges comprising: processing circuitry for verifying during the process of remanufacturing the inkjet cartridges: if the new inkjet chips attached to the remanufactured ink jet cartridges are new inkjet chips, if the new inkjet chips attached to the remanufactured inkjet cartridges were manufactured by a predetermined manufacturer of new inkjet chips, if the new inkjet chips attached to the remanufactured ink jet cartridges are functional, and if the new ink jet chips attached to the remanufacture ink jet cartridges are a predetermined type of new ink jet chip; said processing circuitry for rejecting during the process of remanufacturing the ink jet cartridges: ink jet chips attached to remanufactured ink jet cartridges which have been previously used, ink jet chips attached to remanufactured ink jet cartridges which produced by manufacturers other than the predetermined manufacturer of inkjet chips, ink jet chips attached to remanufactured inkjet cartridges which are not functional, inkjet chips attached to remanufactured inkjet cartridges which are not a predetermined type of new inkjet chips; and a user interface for communicating the verification or rejection of the new ink jet chips from the processing circuitry during the process of remanufacturing; wherein the chip verifier is separate from an inkjet printing device.

2. The inkjet remanufacturing chip verifier for new inkjet chips attached to remanufactured inkjet cartridges of claim 1 wherein the processing circuitry includes a memory device storing inkjet chip reference data.

3. The inkjet remanufacturing chip verifier for new inkjet chips attached to remanufactured inkjet cartridges of claim 2 wherein the processing circuitry reads inkjet chip data from the new inkjet chips and compares the inkjet chip reference data with the inkjet chip data to determine the verification and rejection of the new inkjet chips.

4. A method of remanufacturing inkjet cartridges comprising: providing an ink jet remanufacturing chip verifier for new inkjet chips attached to remanufactured inkjet cartridges comprising processing circuitry for verifying during the process of remanufacturing the inkjet cartridges: if the new inkjet chips attached to the remanufactured ink jet cartridges are new inkjet chips, if the new inkjet chips attached to the remanufactured inkjet cartridges were manufactured by a predetermined manufacturer of new inkjet chips, if the new inkjet chips attached to the remanufactured ink jet cartridges are functional, and if the new ink jet chips attached to the remanufacture ink jet cartridges are a predetermined type of new ink jet chip; said processing circuitry for rejecting during the process of remanufacturing the ink jet cartridges: ink jet chips attached to remanufactured ink jet cartridges which have been previously used, ink jet chips attached to remanufactured ink jet cartridges which produced by manufacturers other than the predetermined manufacturer of inkjet chips, ink jet chips attached to remanufactured inkjet cartridges which are not functional, inkjet chips attached to remanufactured inkjet cartridges which are not a predetermined type of new inkjet chips; said processing circuitry comprising a memory device storing inkjet chip reference data; and a user interface for communicating the verification or rejection of the new ink jet chips from the processing circuitry during the process of remanufacturing; providing a remanufactured inkjet cartridge comprising a new inkjet chip having a memory storing inkjet chip data; reading, by the inkjet remanufacturing chip verifier, the inkjet chip data stored in the memory of the new inkjet chip; comparing the inkjet chip data stored in the memory of the new inkjet chip with the reference data stored in memory of the processing circuitry; and verifying or rejecting the new inkjet chip based on results of the comparison; wherein the verifying is performed outside of an inkjet printer.

5. An inkjet remanufacturing chip verifier for new inkjet chips attached to remanufactured inkjet cartridges comprising: processing circuitry for verifying during the process of remanufacturing the inkjet cartridges: if the new inkjet chips attached to the remanufactured ink jet cartridges are new inkjet chips, if the new inkjet chips attached to the remanufactured inkjet cartridges were manufactured by a predetermined manufacturer of new inkjet chips, if the new inkjet chips attached to the remanufactured inkjet cartridges are functional, and if the new ink jet chips attached to the remanufactured ink jet cartridges are a predetermined type of new ink jet chip; said processing circuitry for rejecting during the process of remanufacturing the ink jet cartridges: ink jet chips attached to remanufactured ink jet cartridges which have been previously used, ink jet chips attached to remanufactured ink jet cartridges which are produced by manufacturers other than the predetermined manufacturer of inkjet chips, ink jet chips attached to remanufactured inkjet cartridges which are not functional, inkjet chips attached to remanufactured inkjet cartridges which are not a predetermined type of new inkjet chips; and a user interface for communicating the verification or rejection of the new ink jet chips from the processing circuitry during the process of remanufacturing; wherein the user interface includes an input device for allowing a user to control operation of the chip verifier.

* * * * *